United States Patent [19]

Hernandez et al.

[11] Patent Number: 4,979,407

[45] Date of Patent: Dec. 25, 1990

[54] BOTTLE OPENER

[76] Inventors: Albert Hernandez, 465 Ocean Pkwy., Brooklyn, N.Y. 11218; William Rendace, 4 Hilltop Rd., Port Washington, N.Y. 11050

[21] Appl. No.: 509,204

[22] Filed: Apr. 16, 1990

[51] Int. Cl.[5] ..... B67B 7/44

[52] U.S. Cl. ..... 81/3.09; 81/3.4; 81/3.43; 81/3.57; 81/3.55

[58] Field of Search ..... 81/3.07, 3.09, 3.4, 81/3.55, 3.57, 3.43; D8/38, 40, 33; 7/151

[56] References Cited

U.S. PATENT DOCUMENTS

| | | | |
|---|---|---|---|
| 1,919,866 | 7/1933 | Schacht | 81/3.4 |
| 2,631,482 | 3/1953 | Reinhart | 81/3.4 |
| 3,604,290 | 9/1971 | Waite | 81/3.4 |
| 3,812,741 | 5/1974 | Heine | D8/40 |
| 4,455,894 | 6/1984 | Roberts | 81/3.4 |
| 4,507,988 | 4/1985 | LoFaso et al. | D8/40 |
| 4,723,465 | 2/1988 | Hughes | 81/3.55 |
| 4,846,024 | 7/1989 | Bryant et al. | 81/3.55 |
| 4,911,038 | 3/1990 | Ferrin | 81/3.55 |

*Primary Examiner*—Roscoe V. Parker
*Attorney, Agent, or Firm*—Goodman & Teitelbaum

[57] ABSTRACT

A bottle opener includes a handle having a substantially circular first bottle opener portion at one end thereof with a centrally disposed first opening extending through the first bottle opener portion to remove a twist-off screw cap from a bottle and can, and a substantially flat second bottle opener portion extending outwardly from the opposite end of the handle with a second opening extending through the second bottle opener portion to remove a pry-off cap from a bottle and can, the second bottle opener portion including an off-set tab at a free end thereof in order to lift a ring-like portion of a lift-off tab of a flip top can to open same. The first bottle opener portion and the handle are constructed in one piece, from a rubber-like material. Engagement members are provided on the walls of the first opening of the first bottle opener portion for gripping and turning the twist-off screw cap. A slot is provided in the first bottle opener portion extending from the first opening therein through the first bottle opener portion and into the handle in order to permit expansion of the first bottle opener portion when being inserted onto the screw cap. The handle includes finger portions on opposite sides of the slot to maintain the first bottle opener portion in contact with the screw cap when the screw cap is being twisted. Preferably, a metal reinforcing member is disposed within the handle.

19 Claims, 1 Drawing Sheet

BOTTLE OPENER

BACKGROUND OF THE INVENTION

This invention relates to a bottle opener and, more particularly, to an opener for removing pry-off caps and twist-off screw caps from a bottle, can and the like, and to lift a ring-like portion of a lift-off tab of flip to cans top open same.

Pry-off caps are well known in the art, and many bottle openers have been designed to open same, where most of these prior art bottle openers vary slightly in construction thereof. In recent years, many bottle and can manufacturers have converted from the conventional pry-off cap to the now popular twist-off screw cap, so that the user can theoretically remove the twist-off screw cap without the use of any tools, by merely grasping the cap between one's fingers and thumb, and then twisting it off. However, many of these twist-off screw caps are not easily removed, particularly by the old, the very young, and especially by arthritic sufferers, due to a flaw in the manufacture thereof. Accordingly, many of these twist-off screw caps are too tightly secured and, therefore, cannot be twisted off merely by using one's hand. Therefore, in many cases, a tool such as a pair of pliers is used to remove a defective twist-off screw cap, which in most cases would damage the cap so that it cannot be used to reseal the bottle, can and the like. Furthermore, when using one's hand, the user may be cut by an improperly formed twist-off screw cap. Additionally, when there is excessive pressure within the bottle or can, such as when the bottle or can has been shaken before attempting to open same, the twist-off screw cap is propelled into the air upon removal, and can thus cause severe damage to the user or the surroundings.

In view of the above, many bottle openers have been designed to open these twist-off screw caps. U.S. Pat. Nos. 2,631,482, 3,604,290 and 3,812,741 disclose such bottle openers. Each of these patents disclose a circular body member having an opening therethrough to receive the twist-off screw cap therein in order to twist the cap off. However, the user of each of these patented bottle openers must still use his fingers and thumb to rotate the bottle opener, which would also be difficult for the old, the very young and arthritic sufferers.

In the case of the flip top can, many users employ a screwdriver to lift the ring-like portion of the lift-off tab of the flip top can, which is not a proper solution to the problem. Accordingly, the improper use of the screwdriver can cause severe damage to the user, such as poking oneself with the metal end of the screwdriver.

In view of the above, there is a need for an improved bottle opener, particularly a single bottle oponer that can be used to open twist-off screw caps, pry-off caps and flip top cans, without requiring the user to search for individual bottle openers in order to open each of these different types of bottles and cans.

SUMMARY OF THE INVENTION

Accordingly, it is an object of the present invention to provide a bottle opener, which overcomes the disadvantages of the prior art bottle openers.

Another object of the present invention is to provide a bottle opener, which can remove both pry-off caps and twist-off screw caps from a bottle, can and the like, and can also lift a ring-like portion of a lift-off tab of flip top cans to open same.

A further object of the present invention is to provide a bottle opener as described above, which has a handle that can provide a lever action which can be easily used by the old, the very young, and especially by arthritic sufferers.

Still another object of the present invention is to provide a bottle opener as described above, which includes a substantially circular bottle opener portion at one end of the handle having a centrally disposed opening extending through the bottle opener portion to receive a twist-off screw cap of a bottle, can and the like to remove the screw cap from the bottle, can and the like.

Yet another object of the present invention is to provide a bottle opener as described above, wherein the bottle opener portion and the handle are constructed in one piece and fabricated from a rubber-like material.

An added object of the present invention is to provide a bottle opener as described above, wherein a reinforcing member is disposed within the handle.

Another object of the present invention is to provide a bottle opener as described above, wherein the reinforcing member includes a substantially flat bottle opener portion for removing a pry-off cap from a bottle, can and the like.

A further object of the present invention is to provide a bottle opener as described above, wherein the substantially flat bottle opener portion of the reinforcing member includes an off-set tab at the free end thereof in order to lift a ring-like portion of a lift-off tab of a flip top can to open same.

Yet another object of the present invention is to provide a bottle opener as described above, which is simple to manufacture, and is easy to use and manipulate.

These objects are achieved in accordance with a preferred embodiment of the present invention, wherein the bottle opener includes a handle having a substantially circular first bottle opener portion at one end thereof with a centrally disposed opening extending through the first bottle opener portion in order to remove a twist-off screw cap from a bottle, can and the like, and a substantially flat second bottle opener portion extending outwardly from the opposite end of the handle with an opening extending through the second bottle opener portion in order to remove a pry-off cap from a bottle, can and the like. The second bottle opener portion includes an off-set tab at a free end thereof in order to lift a ring-like portion of a lift-off tab of a flip top can to open same. The first bottle opener portion and the handle are constructed in one piece and fabricated from a rubber-like material. Engagement members are provided on the walls of the opening of the first bottle opener portion for gripping and turning the twist-off screw cap. A slot extends through the first bottle opener portion from the opening therein on one side and into the handle on the other side in order to permit expansion of the first bottle opener portion when being inserted onto the bottle screw cap. The handle includes finger portions to maintain the first bottle opener portion in contact with the bottle screw cap when the bottle screw cap is being twisted. A metal reinforcing member is disposed within the handle.

BRIEF DESCRIPTION OF THE DRAWINGS

With the above and additional objects and advantages in view, as will hereinafter appear, this invention comprises the devices, combinations and arragements of parts hereinafter described by way of example and illustrated in the accompanying drawings of a preferred embodiment in which.

In the various figures of the drawings, like reference characters designate like parts.

DETAILED DESCRIPTION OF THE PREFERRED EMBODIMENT

Figure 1:
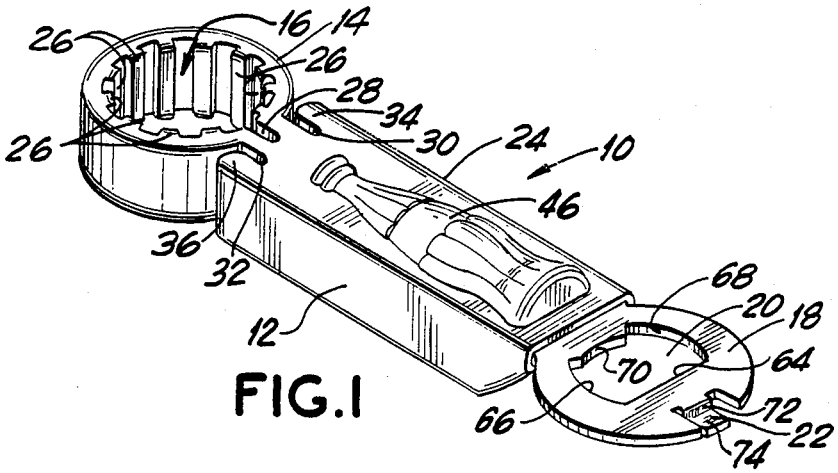
FIG. 1 is a perspective view illustrating the bottle opener in accordance with the present invention.

Referring now to the drawings, FIG. 1 shows a bottle opener 10 in accordance with the present invention. The bottle opener 10 includes a body member 12 having a substantially circular bottle opener portion 14 at one end thereof with a centrally disposed opening 16 extending through the substantially circular bottle opener portion 14 in order to remove a twist-off screw cap from a bottle, can and the like. A substantially flat bottle opener portion 18 extends outwardly from the opposite end of the body member 12 with an opening 20 extending through the substantially flat bottle opener portion 18 in order to remove a pry-off cap from a bottle, can and the like. The substantially flat bottle opener portion 18 also includes an off-set tab 22 at the free end thereof in order to lift a ring-like portion of a lift-off tab of a flip top can to open same. It is noted, that the body member 12 is elongated to define a handle 24 when using the above-mentioned bottle opener portions 14, 18 and off-set tab 22.

Preferably, the body member 12 and the substantially circular bottle opener portion 14 are constructed in one piece, being fabricated from a rubberized plastic, such as covered by the trademark Santoprene manufactured by Monsanto Corporation of Ohio, in order to provide resiliency to the substantially circular bottle opener portion 14, as set forth below. The walls of the opening 16 include engagement members 26, such as protrusions, ridges and the like, for gripping and turning the twist-off screw cap, as set forth below. Additionally, a slot 28 extends from the opening 16 and through the opener portion 14 into the body member 12, the function of which is set forth below. Furthermore, additional slots 30, 32 are provided in the body member 12 on opposite sides of the slot 28 to provide finger portions 34, 36 respectively, the function of which will also be set forth below. Preferably, the free ends of the finger portions 34, 36 are rounded.

Figure 2:
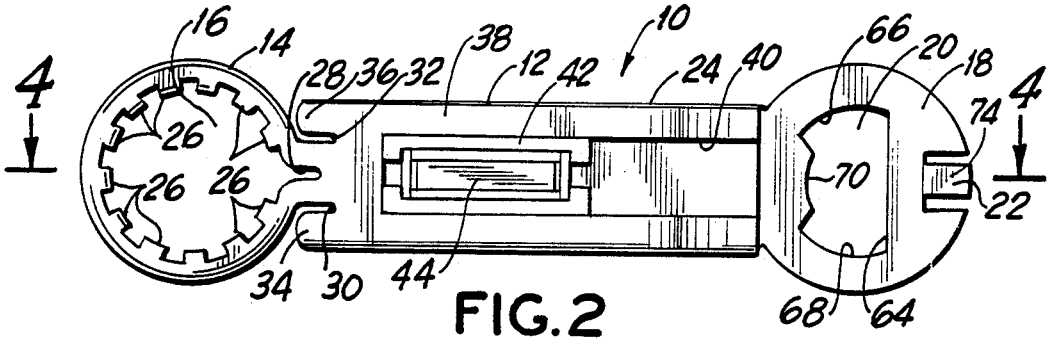
FIG. 2 is a bottom view of the bottle opener shown in FIG. 1.

As shown in FIG. 2, the bottom or back wall 38 of the body member 12 has a recess 40 provided therein, the recess 40 being spaced from the finger portions 34, 36. A plastic housing 42 has a magnet 44 mounted therein so that the bottom surface of the magnet 44 is exposed. The plastic housing 42 is disposed in the recess 40 with an interference force-fit therebetween so that the plastic housing 42 is frictionally held within the recess 40, with the magnet 44 being exposed. If desired, the plastic housing 42 can also be secured within the recess 40 using commercially available cement, glue, adhesive means and the like. Accordingly, the magnet 44 will secure the bottle opener 10 to any metal surface, such as a refrigerator, when the bottle opener 10 is not is use. In order to beautify or identify the bottle opener 10, a raised emblem 46, insignia, logo or the like can be provided on the top surface of the body member 12, as best shown in FIG. 1. It is noted, that the emblem 46 can also be used for advertising, promotions and premiums.

Figure 3:
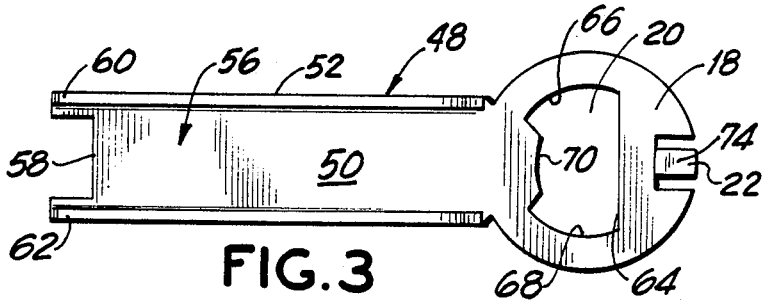
FIG. 3 is a bottom view of an insert member having bottle opening means at one end thereof in accordance with the present invention.
Figure 4:
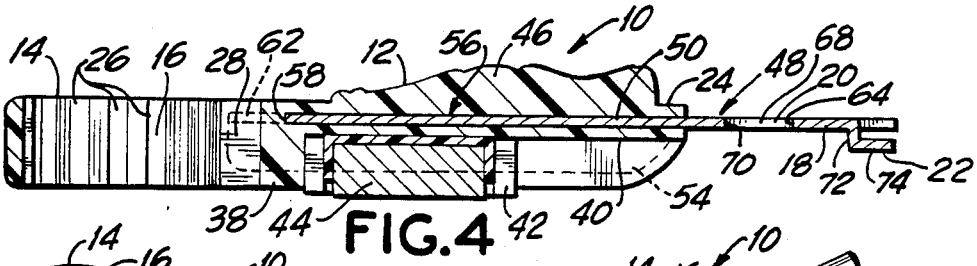
FIG. 4 is a cross-sectional view taken along line 4—4 of FIG. 2.

FIG. 3 shows the bottom view of a metal insert member 48 having a flat upper wall 50 and flanges 52, 54 extending downwardly therefrom to provide a substantially U-shaped reinforcing portion 56 which is embedded in the body member 12, as shown in FIG. 4, to reinforce the body member 12 which is made from resilient material, as mentioned above. The substantially flat bottle opener portion 18 forms and end part of the insert member 48 and extends outwardly from the flat upper wall 50 so that the substantially flat bottle opener portion 18 extends out from the body member 12, as indicated in FIG. 4, and is thus exposed for use thereof. The opposite end of the flat upper wall 50 has a rectangular notch 58 cut therethrough so that the ends 60, 62 of the flanges 52, 54, respectively, are finger-like. Accordingly, when the body member 12 is molded onto the reinforcing portion 56, the flanges 52, 54 are disposed on opposite sides of the recess 40, and the flange end 60 is disposed in the finger portion 36, with the flange end 62 being disposed in the finger portion 34 of the body member 12 for reinforcement of the finger portions 34, 36.

The opening 20 in the substantially flat bottle opener portion 18 has a straight transverse wall 64 adjacent the free end, outwardly curved side walls 66, 68, and an inwardly directed arcuately shaped transverse wall 70 protruding towards the opposite straight transverse wall 64. Preferably, the substantially flat bottle opener portion 18 has a substantially circular outer configuration.

The substantially flat bottle opener portion 18 is used in a conventional manner to remove a pry-off cap from a bottle, can and the like. For example, the bottle opening portion 18 is placed on the bottle cap so that the straight transverse wall 64 rests on top of the bottle cap and the protruding arcuate transverse wall 70 is positioned under the crimped down edge of the bottle cap. The handle 24 of the bottle opener 10 is then lifted to provide a lever action so that the protruding arcuate transverse wall 70 pries off the bottle cap.

The off-set tab 22 includes an off-set portion 72 extending downwardly from the bottle opener portion 18 and a tab portion 74 connected to the off-set portion 72. The tab portion 74 extends outwardly from the off-set portion 72 in the same direction as the free end of the bottle opener portion 18. Thus, the tab portion 74 is positioned below the bottle opener portion 18 and is parallel thereto, where the free end of the tab portion 74 is in alignment with the free end of the bottle opener portion 18. In use, the tab portion 74 is inserted into the ring-like portion of a lift-off tab of a flip top can so that the ring-like portion is disposed between the tab portion 74 and the bottle opener portion 18. The handle 24 of the bottle opener 10 is then lifted to provide a lever action so that the tab portion 74 lifts the lift-off tab of the flip top can to open same.

Figure 5:
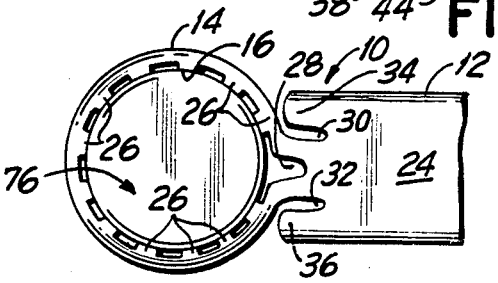
FIG. 5 is a fragmented top view showing the substantially circular bottle opener portion disposed on a twist-off screw cap secured on a bottle.
Figure 6:
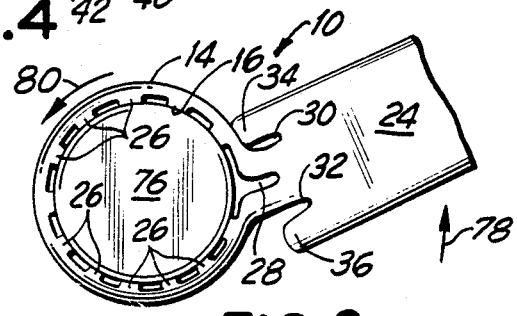
FIG. 6 is a fragmented top view similar to FIG. 7 showing the substantially circular bottle opener portion removing the twist-off screw cap from the bottle.

Referring now to FIGS. 5 and 6, the operation of the substantially circular bottle opener portion 14 will now be described. The opening 16 of the bottle opener portion 14 is placed over the twist-off screw cap 76 of a bottle, can and the like, and the handle 24 of the bottle opener 10 is pushed down so that the walls of the opening 16 completely surround the twist-off screw cap 76. It is noted, that an imaginary circle formed by the free ends of the engagement members 26 on the walls of the opening 16 is slightly smaller than the circumference of the twist-off screw cap 76. Accordingly, during the above downwardly pushing movement, the engagement members 26 are compressed due to the resiliency of the material from which they are formed, thereby creating a force-fit arrangement between the engagement members 26 and the twist-off screw cap 76 so that the engagement members 26 firmly grip the twist-off screw cap 76, as shown in FIG. 5. It is noted, that the slot 28 in the bottle opener portion 14 allows for the expansion of the bottle opener portion 14 so that the imaginary circle of the free ends of the engagement members 26 increases slightly during the compression thereof so as to damage the twist-off screw cap 76. The bottle opener portion 14 is now firmly mounted on the twist-off screw cap 76.

As shown in FIG. 6, the handle 24 of the bottle opener 10 is now turned in the direction of the arrow 78 to provide a lever action so that the bottle opener portion 14 is rotated in a counter-clockwise direction as indicated by the arrow 80. Accordingly, because of the firm grip of the engagement members 26, which tightens and increases the engagement force thereof even more during the counter-clockwise movement of the bottle opener portion 14, the bottle cap 76 is twisted also in a counter-clockwise direction so that the conventional score line formed between the bottle cap 76 and its lower retaining rim is broken, thus leaving the bottle cap 76 free to be rotated by the handle 24 of the bottle opener 10 to unscrew the bottle cap 76 from the bottle, can and the like.

It is noted, that the bottle opener portion 14 may have a tendency to pull away from the bottle cap 76 near the handle 24 during the counter-clockwise movement. Accordingly, the finger portion 34 of the handle 24 presses up against the bottle opener portion 14 when the handle is turned in the direction of the arrow 78, as shown in FIG. 6, so that the bottle opener portion 14 is prevented from pulling away from the bottle cap 76 and thus maintains the firm engagement of the bottle opener portion 14 on the bottle cap 76. Obviously, the other finger portion 36 would function in the same manner if the bottle opener 10 was turned over on the opposite side thereof or if the handle 24 was turned in the opposite direction to the arrow 79. Once the bottle cap 76 is unscrewed from the bottle, can and the like, the bottle cap 76 is removed from the opening 16 of the bottle opener portion 14, where the bottle cap 76 can be used again to reseal the bottle, especially since due to the resilient material of the bottle opener portion 14, there is no damage to the bottle cap 76.

Numerous alterations of the structure herein disclosed will suggest themselves to those skilled in the art, however, it is understood that the present disclosure relates to a preferred embodiment of the invention which is for purposes of illustration only and is not to be construed as a limitation of the invention.

What is claimed is:

1. A bottle opener comprising:

an elongated body member providing a handle for said bottle opener;

said handle having a substantially circular bottle opener portion at one end thereof;

said bottle opener portion being provided with a centrally disposed opening extending therethrough for receiving a twist-off screw cap of a bottle and can therein in a force-fit arrangement;

said handle and bottle opener portion being constructed in one piece being fabricated from a rubber-like material to permit said bottle opener portion to resiliently grip onto the screw cap when forced thereon without damaging the screw cap; and a slot being provided in said bottle opener portion extending from said opening through said bottle opener portion and into said handle to permit said bottle opener portion to expand when being forced onto the screw cap.

2. A bottle opener according to claim 1, wherein walls of said opening are provided with inwardly protruding engagement members for gripping and turning the screw cap.

3. A bottle opener according to claim 1, wherein said handle includes finger portions on opposite sides of said slot facing toward said bottle opener portion for engaging said bottle opener portion to maintain said bottle opener portion in contact with the screw cap when the handle is being turned in a lever action.

4. A bottle opener according to claim 1, wherein said handle has a recess in a wall thereof, a magnet being secured in said recess.

5. A bottle opener according to claim 1, wherein said rubber-like material is a rubberized plastic.

6. A bottle opener comprising:

an elongated body member providing a handle for said bottle opener;

said handle having a substantially circular bottle opener portion at one end thereof;

said bottle opener portion being provided with a centrally disposed opening extending therethrough for receiving a twist-off screw cap of a bottle and can therein in a force-fit arrangement;

said handle and bottle opener portion being constructed in one piece and being fabricated from a rubber-like material to permit said bottle opener portion to resiliently grip onto the screw cap when forced thereon without damaging the screw cap; and said handle including finger portions on opposite sides thereof facing toward said bottle opener portion for engaging said bottle opener portion to maintain said bottle opener portion in contact with the screw cap when the handle is being turned in a lever action.

7. A bottle opener according to claim 6, wherein said handle includes a metal reinforcing member therein.

8. A bottle opener comprising;

an elongated body member providing a handle for said bottle opener;

said handle having a substantially circular bottle opener portion at one end thereof;

said bottle opener portion being provided with a centrally disposed opening extending therethrough for receiving a twist-off screw cap of a bottle and can therein in a force-fit arrangement;

said handle and bottle opener portion being constructed in one piece and being fabricated from a rubber-like material to permit said bottle opener portion to resilient grip onto the screw cap when forced thereon without damaging the screw cap;

said handle including a metal reinforcing member therein;

a substantially flat portion of said reinforcing member extending out of an opposite end of said handle to provide a second bottle opener portion; and said second bottle opener portion having a second opening extending therethrough for receiving a pry-off cap of a bottle and can therein.

9. A bottle opener according to claim 8, wherein a first transverse wall of said second opening of said bottle opener portion is straight, and an opposite second transverse wall of said second opening is acuately shaped and extends inwardly towards said first transverse wall.

10. A bottle opener according to claim 8, wherein said substantially flat portion of said reinforcing member includes an off-set tab at a free end thereof to lift a ring-like portion of a lift-off tab of a flip top can to open same.

11. A bottle opener according to claim 8, wherein said handle has a recess in a wall thereof, a magnet being secured in said recess.

12. A bottle opener according to claim 11, wherein said reinforcing member includes spaced apart flanges disposed on opposite sides of said recess.

13. A bottle opener comprising:

an elongated body member providing a handle for said bottle opener;

said handle having a substantially circular bottle opener portion at one end thereof;

said bottle opener portion being provided with a centrally disposed opening extending therethrough for receiving a twist-off screw cap of a bottle and can therein in a force-fit arrangement;

said handle and bottle opener portion being constructed in one piece and being fabricated from a rubber-like material to permit said bottle opener portion to resiliently grip onto the screw cap when forced thereon without damaging the screw cap;

said handle including a metal reinforcing member therein;

said handle having a recess in a wall thereof, a magnet being secured in said recess;

said reinforcing member including spaced apart flanges disposed on opposite sides of said recess;

said flanges include finger-like ends extending into finger portions; and said finger portions being provided on opposite sides of said handle and facing toward said bottle opener portion for engaging said bottle opener portion to maintain said bottle opener portion in contact with the screw cap when the handle is being turned in a lever action.

14. A bottle opener according to claim 13, wherein a substantially flat portion of said reinforcing member extends out of an opposite end of said handle to provide a second bottle opener portion, said second bottle opener portion having a second opening extending therethrough for receiving a pry-off cap of a bottle and can.

15. A bottle opener according to claim 14, wherein a first transverse wall of said second opening of said second bottle opener portion is straight, and an opposite second transverse wall of said second opening is arcuately shaped and extends inwardly towards said first transverse wall.

16. A bottle opener according to claim 14, wherein said substantially flat portion of said reinforcing member includes an off-set tab at a free end thereof to lift a ring-like portion of a lift-off tab of a flip top can to open same.

17. A bottle opener according to claim 13, wherein a slot is provided in said bottle opener portion extending from said opening through said bottle opener portion and into said handle between said finger portions to permit said bottle opener portion to expand when being forced onto the screw cap.

18. A bottle opener according to claim 17, wherein walls of said opening are provided with inwardly protruding engagement members for gripping and turning the screw cap.

19. A bottle opener comprising:

an elongated body member providing a handle for said bottle opener;

said handle having a subtantially circular bottle opener portion at one end thereof;

said bottle opener portion being provided with a centrally disposed opening extending therethrough for receiving a twist-off screw cap of a bottle and can therein in a force-fit arrangement;

said handle and bottle opener portion being constructed in one piece and being fabricated from a rubber-like material to permit said bottle opener portion to resiliently grip onto the screw cap when forced thereon without damaging the screw cap;

said handle including a metal reinforcing member therein; and a substantially flat portion of said reinforcing member extending out of an opposite end of said handle to provide an off-set tab at a free end thereof to lift a ring-like portion of a lift-off tab of a flip top can to open same.

* * * * *